US005468936A

United States Patent [19]

Deevi et al.

[11] Patent Number: 5,468,936

[45] Date of Patent: Nov. 21, 1995

[54] HEATER HAVING A MULTIPLE-LAYER CERAMIC SUBSTRATE AND METHOD OF FABRICATION

[75] Inventors: Seetharama C. Deevi, Midlothian; Mohammad R. Hajaligol; Pamela D. Lieberman, both of Richmond; Walter A. Nichols, Chesterfield; Michael L. Watkins, Chester, all of Va.

[73] Assignee: Philip Morris Incorporated, New York, N.Y.

[21] Appl. No.: 35,733

[22] Filed: Mar. 23, 1993

[51] Int. Cl.[6] ..... H05B 3/16; H05B 3/26

[52] U.S. Cl. ..... 219/553; 219/543

[58] Field of Search ..... 219/553, 543; 392/390; 338/306, 308, 309, 312, 314; 420/463; 131/194, 273, 274, 275; 128/202.21, 202.27, 203.17, 203.26; 156/85

[56] References Cited

U.S. PATENT DOCUMENTS

| | | | |
|---|---|---|---|
| 3,496,336 | 2/1970 | Hingorany et al. | 219/464 |
| 3,568,127 | 3/1971 | Aimi | 338/308 |
| 3,978,315 | 8/1976 | Martin et al. | 219/543 |
| 4,100,524 | 7/1978 | Kirsch | 338/308 |
| 4,104,421 | 8/1978 | Maher et al. | 338/308 |
| 4,203,025 | 5/1980 | Nakatani et al. | 219/543 |
| 4,259,564 | 3/1981 | Ohkubo et al. | 219/216 |
| 4,261,764 | 4/1981 | Narayan | 148/1.5 |
| 4,298,786 | 11/1981 | Marciniec | 219/216 |
| 4,314,230 | 2/1982 | Cardinal et al. | 338/314 |
| 4,378,489 | 3/1983 | Chabinsky et al. | 219/543 |
| 4,464,420 | 8/1984 | Taguchi et al. | 338/308 |
| 4,471,005 | 9/1984 | Cheng et al. | 427/89 |
| 4,517,449 | 5/1985 | Chazan et al. | 219/549 |
| 4,548,662 | 10/1985 | Chazan et al. | 156/86 |
| 4,659,912 | 4/1987 | Derbyshire | 219/535 |
| 4,701,427 | 10/1987 | Boecker et al. | 501/92 |
| 4,707,909 | 11/1987 | Blanchard | 437/109 |
| 4,766,409 | 8/1988 | Mandai | 338/22 R |
| 4,772,488 | 9/1988 | Pinch et al. | 427/39 |
| 4,777,022 | 10/1988 | Boldfish et al. | 422/245 |
| 4,777,060 | 10/1988 | Mayr et al. | 427/34 |
| 4,778,649 | 10/1988 | Niino et al. | 419/9 |
| 4,780,248 | 10/1988 | Donohue et al. | 252/518 |
| 4,785,279 | 11/1988 | Wetzel | 338/314 |
| 4,788,045 | 11/1988 | Colombet et al. | 423/85 |
| 4,788,523 | 11/1988 | Robbins | 338/309 |
| 4,791,078 | 12/1988 | Saito et al. | 501/136 |
| 4,799,983 | 1/1989 | Desai | 156/89 |
| 4,806,739 | 2/1989 | Kojima et al. | 219/543 |
| 4,814,586 | 3/1989 | Grise | 219/549 |
| 4,819,128 | 4/1989 | Florian et al. | 361/321 |
| 4,822,983 | 4/1989 | Bremner et al. | 219/505 |
| 4,830,876 | 5/1989 | Dietrich et al. | 427/96 |
| 4,839,227 | 6/1989 | Hoopman | 428/343 |

(List continued on next page.)

FOREIGN PATENT DOCUMENTS

| | | | |
|---|---|---|---|
| 0160761 | 11/1985 | European Pat. Off. . | |
| 0438862 | 7/1991 | European Pat. Off. . | |
| 64-17386 | 1/1989 | Japan | 219/553 |
| 2148079 | 5/1985 | United Kingdom . | |
| 2148676 | 5/1985 | United Kingdom . | |
| 2168381 | 6/1986 | United Kingdom . | |

OTHER PUBLICATIONS

J. B. Blum, "Sol–Gel Processing of Ceramics for Microelectronic Applications," International Journal for Hybrid Microelectronics, vol. 8, No. 3, Sep. 1985.

*Primary Examiner*—Geoffrey S. Evans
*Attorney, Agent, or Firm*—Kevin B. Osborne; James E. Schardt; Charles E. B. Glenn

[57] ABSTRACT

A heater having a multiple-layer ceramic substrate and a method for fabricating the heater are provided. The heater consists-of a plurality of ceramic layers which are laminated to form a single ceramic substrate. A plurality of resistive heating elements are deposited onto the multiple-layer ceramic substrate, which are connectable to a power source via conductive elements which extend through the substrate to the resistive heating elements. The heater may also include a terminal that allows for convenient electrical and mechanical interfacing to a smoking article.

27 Claims, 11 Drawing Sheets

U.S. PATENT DOCUMENTS

| | | | |
|---|---|---|---|
| 4,845,839 | 7/1989 | Brown | 29/620 |
| 4,848,348 | 7/1989 | Craighead | 128/639 |
| 4,849,251 | 7/1989 | Tanaka | 427/101 |
| 4,879,653 | 12/1988 | Ogata et al. | 501/134 |
| 4,883,947 | 11/1989 | Murase et al. | 219/553 |
| 4,885,661 | 12/1989 | Yokotani et al. | 361/321 |
| 4,889,961 | 12/1989 | Carlson | 29/846 |
| 4,889,974 | 12/1989 | Auding et al. | 219/543 |
| 4,895,771 | 1/1990 | Souter et al. | 428/670 |
| 4,899,126 | 2/1990 | Yamada | 338/309 |
| 4,904,526 | 2/1990 | Koskenmaki | 428/328 |
| 4,908,599 | 3/1990 | Breen et al. | 338/22 |
| 4,914,417 | 4/1990 | Matsui et al. | 338/174 |
| 4,919,744 | 4/1990 | Newman | 156/308.2 |
| 4,930,045 | 5/1990 | Carlson et al. | 361/329 |
| 4,985,176 | 1/1991 | Watanabe et al. | 252/521 |
| 4,987,108 | 1/1991 | Takagi et al. | 501/138 |
| 5,060,671 | 10/1991 | Counts et al. | 131/329 |
| 5,093,894 | 3/1992 | Deevi et al. | 392/390 |
| 5,095,921 | 3/1992 | Losee et al. | 131/194 |
| 5,164,699 | 11/1992 | Smith et al. | 338/308 |
| 5,176,771 | 1/1993 | Bravo et al. | 156/85 |
| 5,199,791 | 4/1993 | Kasanami et al. | 338/314 |
| 5,268,558 | 12/1993 | Youssef et al. | 219/543 |

FIG. 2a
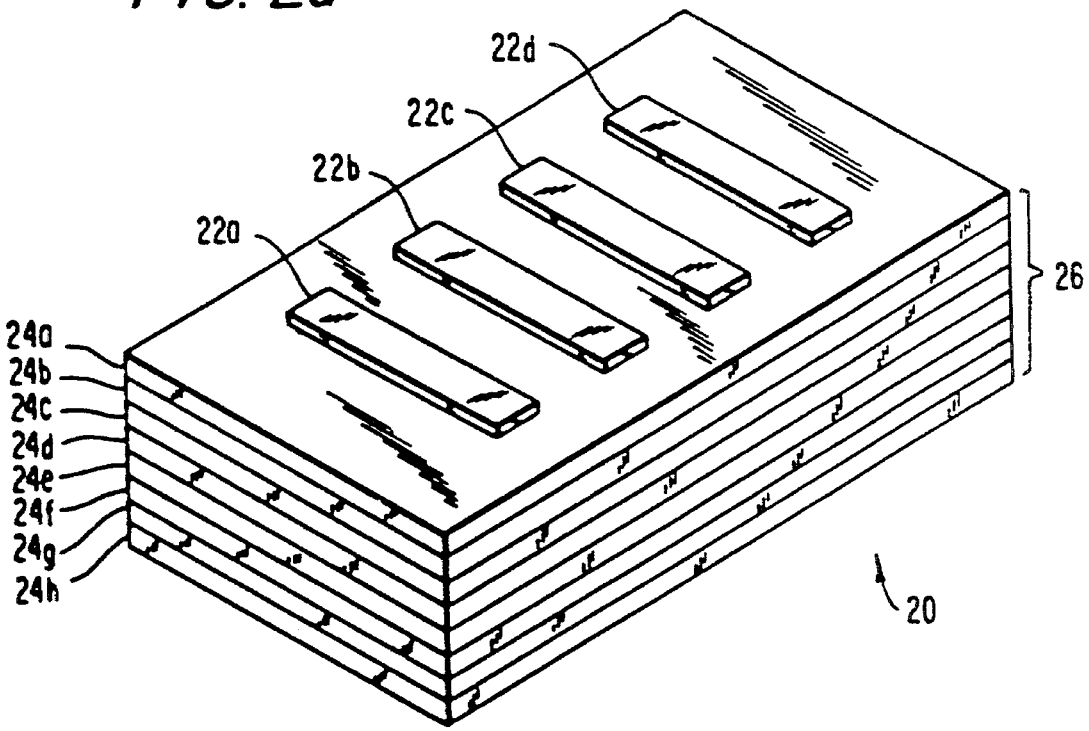
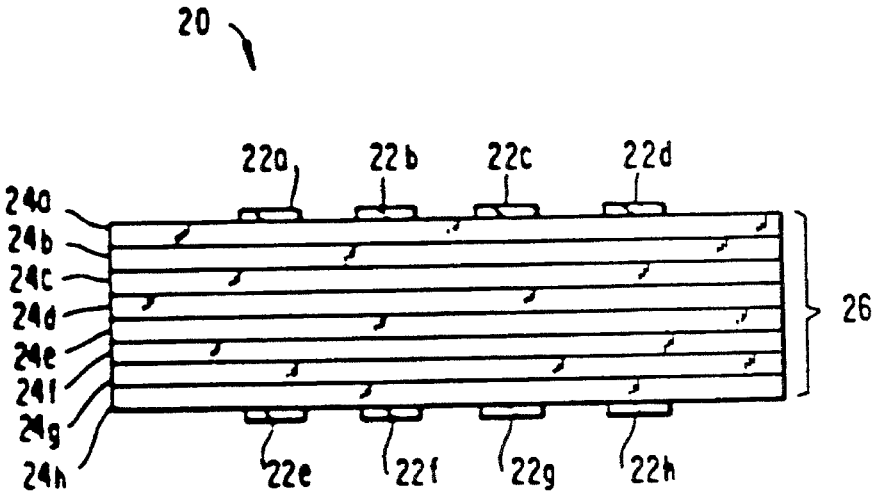
FIG. 2b

FIG. 4a
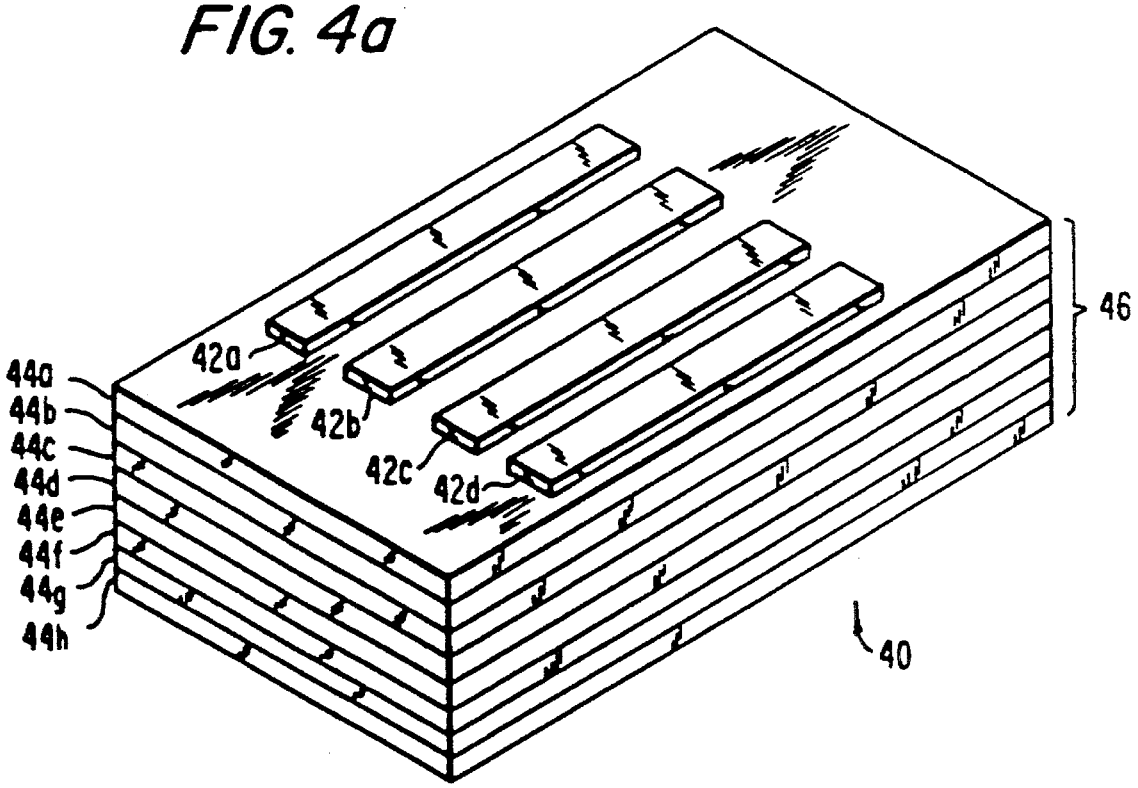
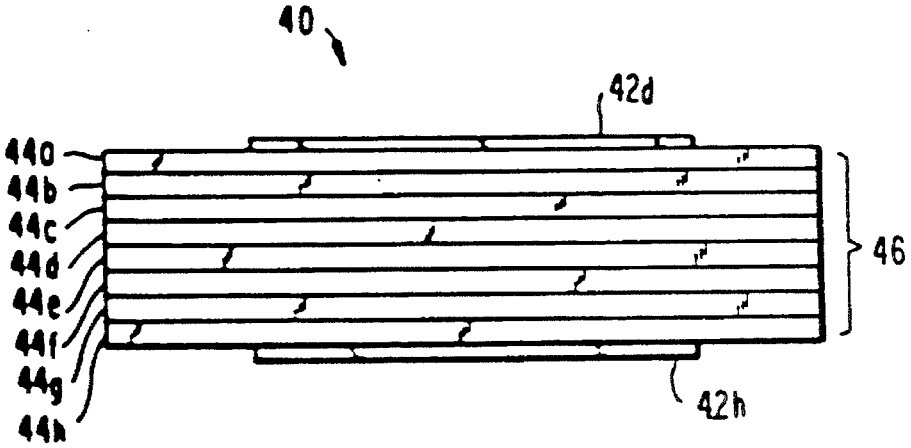
FIG. 4b

FIG. 9a
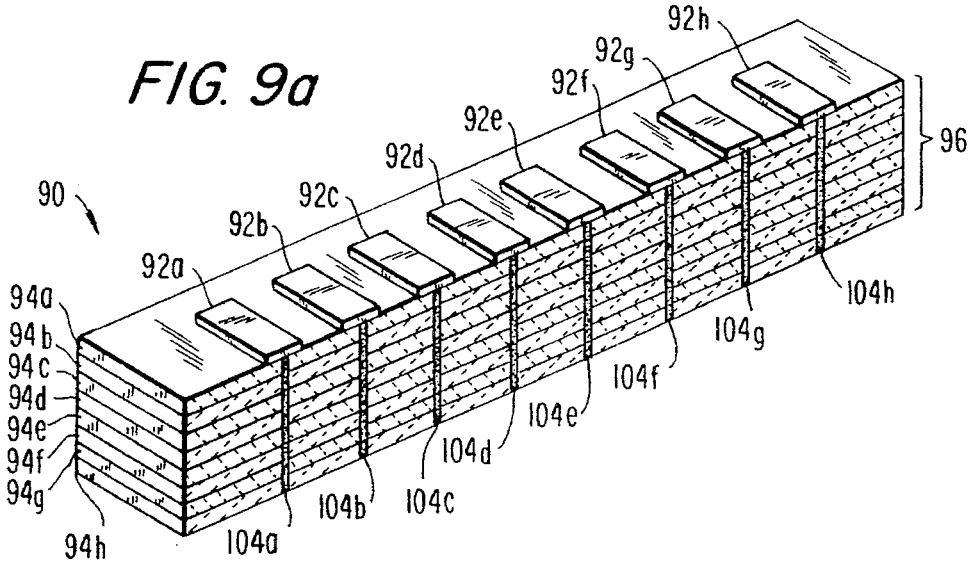
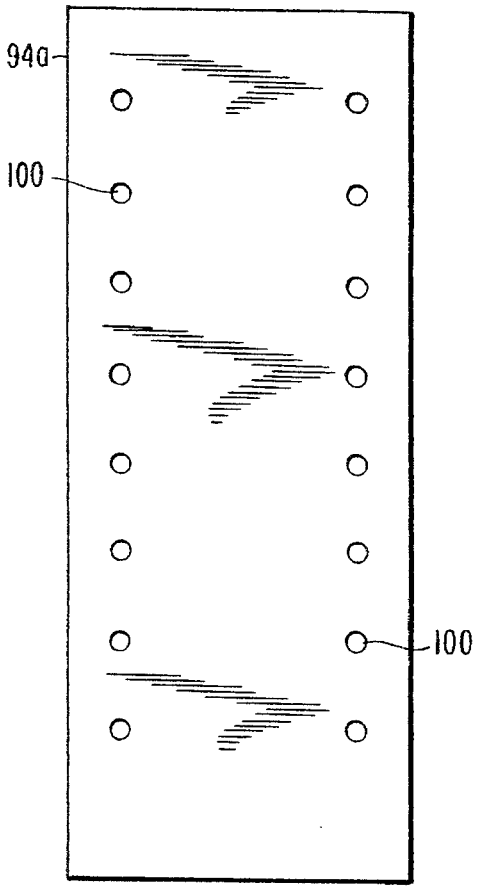
FIG. 9b
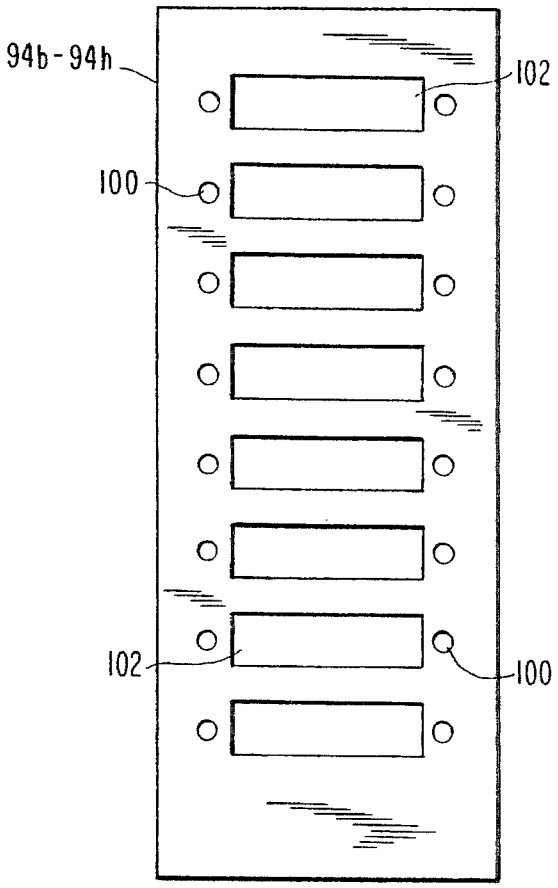
FIG. 9c

HEATER HAVING A MULTIPLE-LAYER CERAMIC SUBSTRATE AND METHOD OF FABRICATION

BACKGROUND OF THE INVENTION

This invention relates to ceramic heaters for use in electrical smoking articles. More particularly, this invention relates to heaters having multiple-layer ceramic substrates capable of supporting a plurality of resistive heating elements.

A type of electrical smoking article is described in commonly-assigned U.S. Pat. No. 5,060,671, and commonly-assigned U.S. patent application Ser. No. 07/943,504, filed on Sep. 11, 1992, which are hereby incorporated by reference. In this type of smoking article, a tobacco flavor medium is heated as a result of a transfer of thermal energy from a heating element. As the tobacco flavor medium is heated, a smoker at the mouth or downstream end of the smoking article draws air in and around the heated tobacco flavor medium by inhaling, and thereby receives a tobacco-flavored aerosol or vapor.

In order to produce a tobacco-flavored vapor or aerosol, an electrical smoking article must be capable of elevating the temperature of a tobacco flavor medium to at least 400° C. preferably to a temperature in the range of from about 400° C. to about 650° C. The smoking article should allow the smoker to draw naturally, and should provide a tobacco-flavored aerosol or vapor with little delay after draw. To provide rapid delivery of a tobacco-flavored aerosol or vapor, an electrically powered resistive heating element disposed within the smoking article should be capable of reaching the aerosol-generating temperature within 2 seconds, preferably in about 1 second.

Batteries that are suitable for use in smoking articles have electrical characteristics that require the resistance of the heating elements to be in a relatively narrow range, typically between about 1 Ω and about 4 Ω. Since the smoking article should preferably be similar in size to a conventional cigarette, it would be advantageous to provide a heater that is relatively compact. However, it is also important for the heater to have sufficient mechanical strength to enable it to withstand frequent handling by a smoker. It has proven difficult to provide a heater for use in a smoking article having the required combination of resistance, size and mechanical strength.

Many ceramic materials have exceptional thermal properties, and accordingly, they have been used as insulating substrates for printed or adhered solid resistive heaters. However, it has been found that the mass of the substrate is a limiting factor in the effective transfer of heat from the resistive heating elements to a tobacco flavor medium in a smoking article. When the mass of the substrate is too great, the substrate will absorb a large amount of the heat generated by the resistive heating elements. If the thickness of the ceramic substrate is reduced, mechanical strength is sacrificed.

In view of the foregoing, it would be desirable to provide a heater, and a process for fabricating a heater, having a thermally stable, multiple-layer ceramic-substrate.

It would also be desirable to provide a heater, and a process for fabricating a heater, which minimizes heat transfer to the environment, without sacrificing a substantial amount of mechanical strength.

It would further be desirable to provide a -process for fabricating a heater that uses known green ceramic tape technology.

It would still further be desirable to provide a heater, and a process for fabricating a heater, which includes convenient mechanical and electrical interfaces.

It would even further be desirable to provide a heater, and a process for fabricating a heater, which is suitable for heating a tobacco flavor medium to a temperature in the range of from about 400° C. to about 650° C. in about 1 second.

SUMMARY OF THE INVENTION

Accordingly, it is an object of this invention to provide a heater, and a process for fabricating a heater, having a thermally stable, multiple-layer ceramic substrate.

It is also an object of this invention to provide a heater, and a process for fabricating a heater, which minimizes heat transfer to the environment, without sacrificing a substantial amount of mechanical strength.

It is a further object of this invention to provide a process for fabricating a heater that uses known green ceramic tape technology.

It is a still further object of this invention to provide a heater, and a process for fabricating a heater, which includes convenient mechanical and electrical interfaces.

It is an even further object of this invention to provide a heater, and a process for fabricating a heater, which is suitable for heating a tobacco flavor medium to a temperature in the range of from about 400° C. to about 650° C. in about 1 second.

In accordance with this invention, there is provided an electrically powered heater having at least one, but preferably a plurality of resistive heating elements deposited onto a ceramic substrate. The substrate is formed from multiple layers of a ceramic material adhered together so as to provide a single ceramic substrate. The heater having a multiple-layer ceramic substrate includes conductive elements for receiving electrical energy from a power source associated with the smoking article and delivering the electrical energy to the resistive heating elements.

When a ceramic heater having a plurality of resistive heating elements is used in a smoking article, the resistive heating elements are preferably connected to a power source such that they can be independently actuated. Tobacco flavor medium is positioned in the smoking article in such a way as to allow for the transfer of thermal energy from the resistive heating elements to the tobacco flavor medium. Preferably, the tobacco flavor medium is applied to the heater such that when power is supplied to a given resistive heating element, heat produced by that segment is transferred to a portion of the tobacco flavor medium. When heated, the tobacco flavor medium provides a tobacco-flavored aerosol or vapor which may be inhaled by the smoker.

The application of electrical energy to a given resistive heating element is coincident with the smoker puffing on the smoking article. With each puff, a different heating element is supplied with power, until all of the resistive heating elements on the heater having a multiple-layer ceramic substrate have been supplied with power once, at which point, the device would be depleted. The process by which electrical power is successively switched to each resistive heating element could be controlled directly by the smoker or triggered by control circuitry.

One advantage of a heater having a multiple-layer ceramic substrate is that it is very efficient in heating the tobacco flavor medium. Each heating element is intended to receive electrical energy only when the smoker draws on the smoking article. A substantial amount of energy is conserved by reducing the time the heater is activated, thus allowing for a reduction in the size of the power source. It is important to minimize the size of the smoking article components, in order to allow them to fit into a smoking article similar in size and shape as a conventional cigarette.

The heaters of the present invention having multiple-layer ceramic substrates may be fabricated using "green tape" technology. By using this technology, the mass of the substrate that supports the resistive heating elements can be reduced, while maintaining mechanical strength. In a preferred embodiment, this is accomplished by layering thin sheets of unfired ceramic material having selected regions removed from individual layers. Unfired ceramic material that is suitable for use in the preparation of substrate layers is commercially available in rolls, and is commonly known as "green ceramic tape". The layers are laminated and fired to form a single ceramic substrate having cavities or air gaps corresponding to the regions removed from the individual layers.

In one preferred embodiment of the present invention, the substrate layer upon which resistive heating elements are deposited, known as a surface substrate layer, is left intact, so that the cavities are internal to the ceramic heater and below the resistive heating elements. In another preferred embodiment, the surface substrate layer also has regions removed so that the individual resistive heating elements are separated by air gaps in the substrate, thereby substantially reducing the thermally conductive pathways between heaters. In another alternative embodiment, a second surface substrate layer that does not have regions removed is laminated to the lower surface of a heater comprising air gaps or cavities. In still another alternative embodiment, the heater has a second surface substrate layer upon which resistive heating elements are deposited. Cavities and air gaps may also be incorporated into a heater having resistive heating elements on two surface substrate layers.

Heaters having multiple-layer substrates manufactured in accordance with the principles of the present invention provide convenient mechanical and electrical interfaces to a power source and other components in the smoking article. In a preferred embodiment of the invention, each layer of the multiple-layer ceramic substrate comprises via holes filled with a conductive material. When the substrate layers are laminated, the via holes are aligned so as to form electrically conductive conduits that extend from the resistive heating elements through the continuous regions of the laminated substrate layers to the underside of the heater. The electrically conductive conduits are located so as to provide independent electrical connections to each resistive heating element. Thus, each resistive heating element can be individually connected to a power source by using, for example, an electrical connector in the smoking article that complements the positioning of the electrically conductive conduits.

In another preferred embodiment of the present invention, electrically conductive traces are deposited onto selected layers of the multiple-layer ceramic substrate. Preferably, each layer comprises a conductive trace that provides an electrical connection to one resistive heating element. The conductive traces terminate in proximity to one another near one end of the ceramic heater, thus forming a terminal that provides a convenient mechanical and electrical interface to the smoking article.

BRIEF DESCRIPTION OF THE DRAWINGS

The above and other objects and advantages of the present invention will be apparent on consideration of the following detailed description, taken in conjunction with the accompanying drawings, in which like reference characters refer to like parts throughout and in which:

FIGS. 2*a* and 2*b* are, respectively, a perspective view and a side view of another illustrative embodiment of a heater in accordance with the principles of the present invention, in which resistive heating elements are deposited onto both surface substrate layers;

FIGS. 4*a* and 4*b* are, respectively, a perspective view and a side view of a fourth illustrative embodiment of a heater in accordance with the principles of the present invention, in which resistive heating elements are deposited onto both surface substrate layers, and in which the longer lengths of the resistive heating elements are in parallel with the longer length of the heater;

FIGS. 9*a*–9*c* illustrate a process by which a heater comprising electrically conductive conduits is fabricated in accordance with the principles of the present invention.

DETAILED DESCRIPTION OF THE INVENTION

Figure 1:
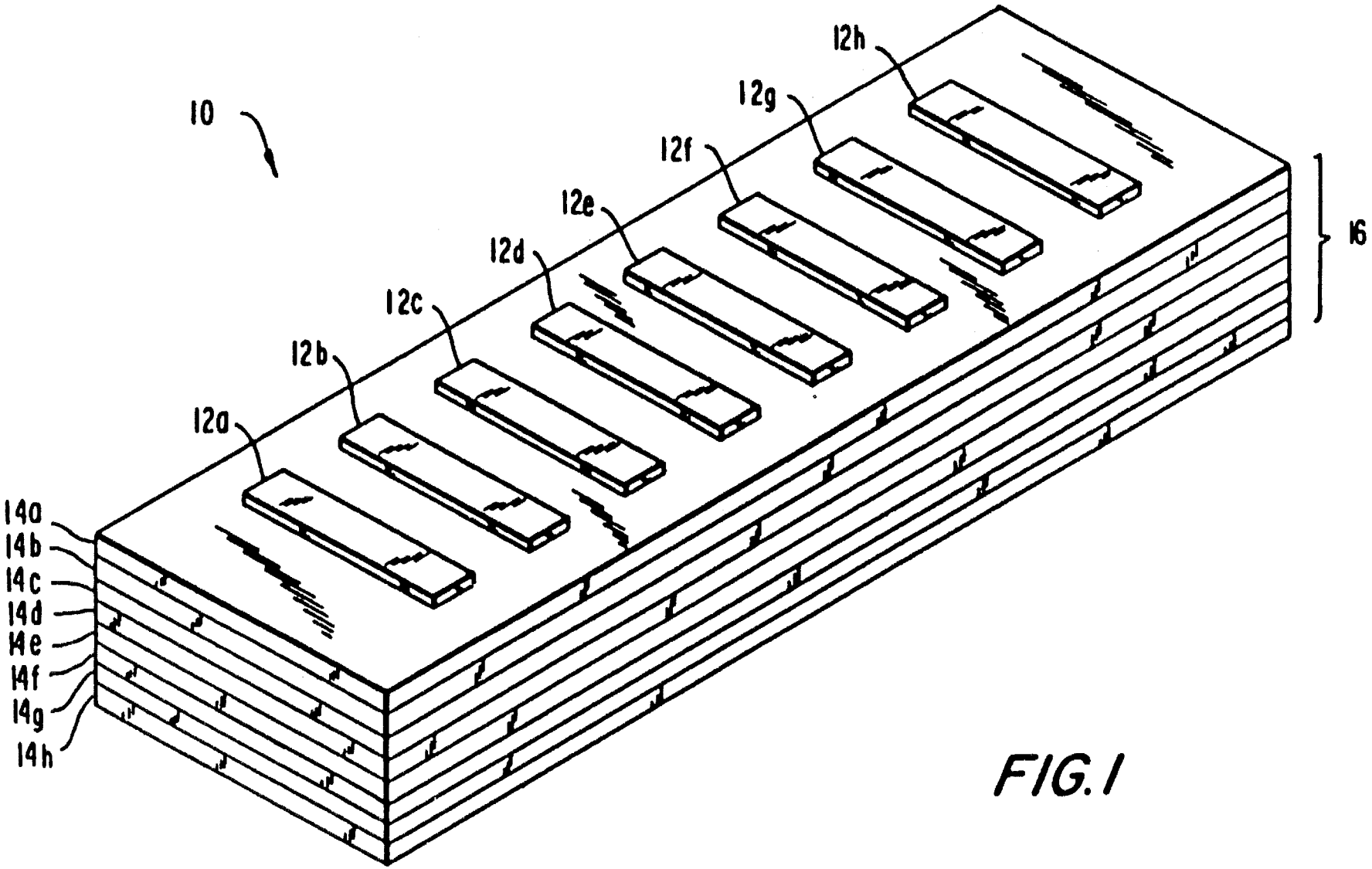
FIG. 1 is a perspective view of an illustrative embodiment of a heater in accordance with the principles of the present invention, having a multiple-layer ceramic substrate and a plurality of resistive heating elements deposited onto one surface substrate layer.

Referring to FIG. 1, an illustrative embodiment of a heater having a multiple-layer ceramic substrate and a plurality of resistive heating elements is described. Heater 10 comprises resistive heating elements 12*a*–12*h* deposited onto surface substrate layer 14*a* of multiple-layer ceramic substrate 16. Substrate 16 comprises a plurality of ceramic substrate layers 14*a*–14*h*. Substrate 16 is rigid enough to provide mechanical support for resistive heating elements 12*a*–12*h*, yet flexible enough to resist fracture during the manufacturing process and in use. Substrate 16 is thermally stable at elevated temperatures, and will not deform or become chemically reactive at temperatures required to generate tobacco-flavored vapors or aerosols.

Resistive heating elements 12*a*–12*h* may be connected to a power source in a manner that allows each resistive heating element to be independently activated. Heating element activation may be controlled directly by the smoker, or by control circuitry. Preferably, the electrical connections between resistive heating elements 12*a*–12*h* and a power source are made by electrically conductive conduits and conductive traces (which are described in greater detail below) that are substantially internal to heater 10. Alternatively, conventional wires may be attached to low-resistance electrical contacts disposed on the ends of resistive heating element 12*a*–12*h*.

FIGS. 2*a* and 2*b*, 3, and 4*a* and 4*b* depict further illustrative external geometries for heaters having multiple-layer ceramic substrates, fabricated in accordance with the principles of the present invention. FIGS. 2*a* and 2*b* depict heater 20 having resistive heating elements 22*a*–22*d* deposited onto surface substrate layer 24*a* of substrate 26, and resistive heating elements 22*e*–22*h* deposited onto surface substrate layer 24*h* of substrate 26. Preferably substrate 26 further includes substrate layers 24*b*–24*g* between surface substrate layers 24*a* and 24*h*. This embodiment allows for a significant reduction in the length of heater 20, without reducing the number or size of resistive heating elements 22*a*–22*h*.

Figure 3:
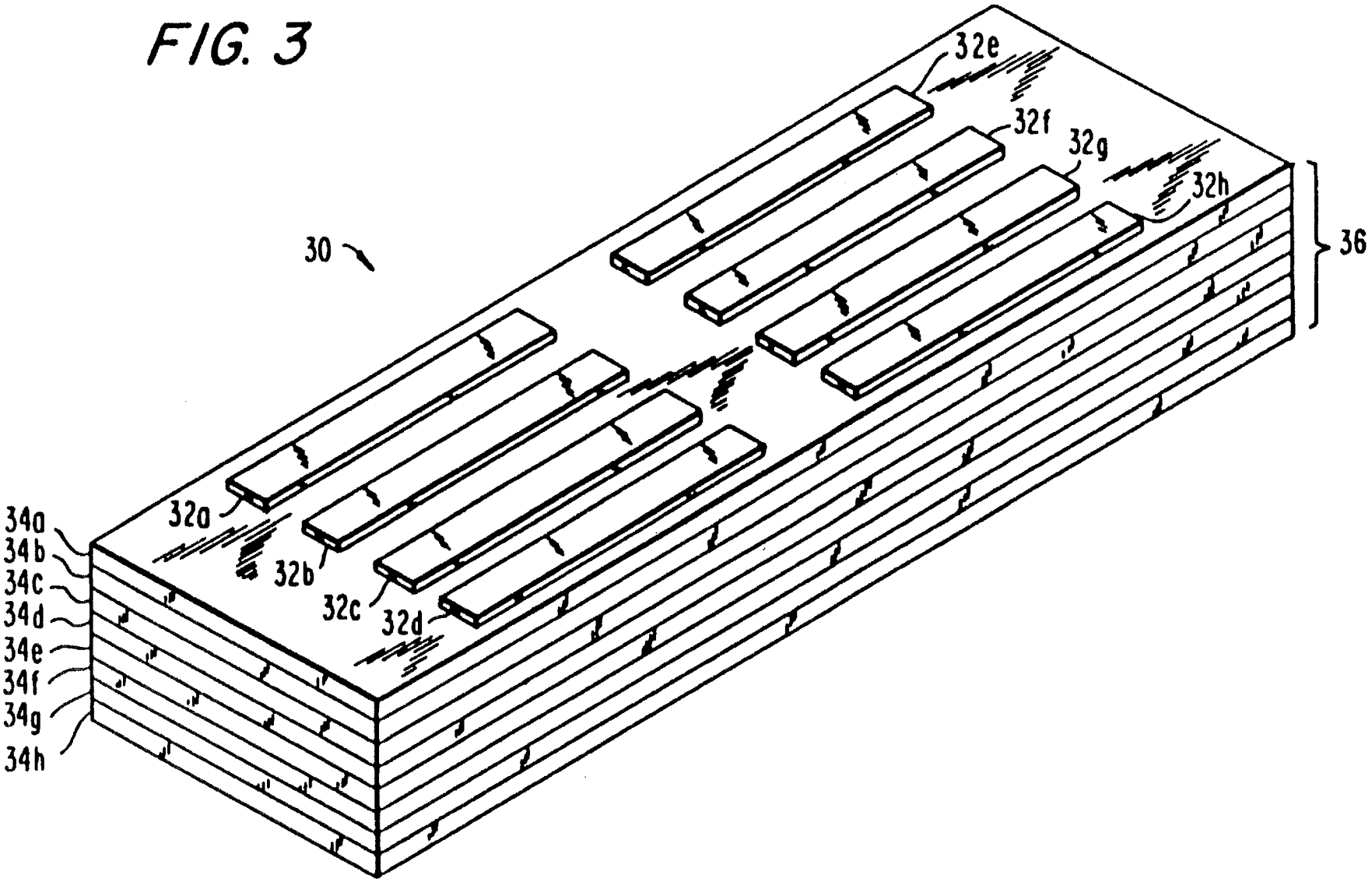
FIG. 3 is a perspective view of a third illustrative embodiment of a heater in accordance with the principles of the present invention, in which the resistive heating elements are deposited so that the longer lengths of the resistive heating elements are in parallel with the longer length of the heater.

FIG. 3 depicts a heater embodiment in which heater 30 has resistive heating elements 32*a*–32*h* deposited onto surface substrate layer 34*a* of substrate 36, and arranged so that the longer lengths of resistive heating elements 32*a*–32*h* are in parallel with the longer length of heater 30. Substrate 36 also includes substrate layers 34*b*–34*h*, which advantageously provide additional mechanical support.

FIGS. 4*a* and 4*b* depict a configuration similar to that of FIG. 3, in which resistive heating elements 42*a*–42*h* of heater 40rare deposited onto both surface substrate layers 44*a* and 44*h* of substrate 46. (Only resistive heating elements 42*a*–42*d* and 44*h* are visible in FIGS. 4*a* and 4*b*.)

Although the heater embodiments described with respect to FIGS. 1, 2*a* and 2*b*, 3, and 4*a* and 4*b* are all substantially rectangular, the principles of the present invention may be applied to produce heaters in a variety of shapes. In addition, the number of resistive heating elements, as well as the number of substrate layers, may be varied to produce heaters meeting the requirements of a particular application.

The principles of the present invention may also be applied to fabricate heaters having internal resistive heating elements. Using heater 10 described with respect to FIG. 1 as an example, resistive heating elements 12*a*–12*h* may be deposited onto the interior surface of surface substrate layer 14*a* (the surface in contact with substrate layer 14*b*) prior to the step of laminating substrate layers 14*a*–14*h* to form substrate 16. Depending on the internal geometry of heater 10 (variations of which are discussed below), resistive heating elements 12*a*–12*h* may be exposed to a cavity, or a plurality of cavities, within heater 10.

The resistivity of the resistive heating elements deposited onto a heater fabricated in accordance with the principles of the present invention must be such that when current flows through a resistive heating element, a temperature sufficient to cause the tobacco flavor medium to produce an aerosol or vapor is achieved. Typical operating temperatures are preferably in the range of from about 100° C. to about 650° C., more preferably between about 250° C. and about 500° C., and most preferably between about 350° C. and about 450° C. However, the resistivity cannot be so high as to be incompatible with available batteries, nor can it be so low that the power consumption of the resistive heating elements exceeds the capacity of the power source. Typically, the resistive heating elements should have resistances between about 0.2 Ω and about 2.0 Ω, preferably between about 0.5 Ω and about 1.5 Ω and most preferably between about 0.8 Ω and about 1.2 Ω, in order to achieve the desired operating temperatures when connected to a power source of between about 2.4 volts and about 9.6 volts.

Throughout their range of operating temperatures, the resistive heating elements should be chemically non-reactive with the tobacco flavor medium being heated, so as to not adversely affect the flavor or content of the aerosol or vapor produced by the tobacco flavor medium. Furthermore, the resistive heating elements should provide a uniform temperature distribution across their surfaces with only minimal thermal gradients. Similarly, each resistive heating element should provide a uniform voltage drop and current flow between its power contacts. Each resistive heating element should be thermally isolated from other heating elements by the multiple-layer ceramic substrate, or preferably, by air gaps or cavities in the substrate (described in greater detail below). The heater should be designed to minimize heat loss to the multiple-layer ceramic substrate, preferably by employing a material having a high electrical resistance and low thermal conductivity.

In order to provide flavor and aroma similar to that of a conventional cigarette, a heater having a multiple-layer ceramic substrate, when used in a smoking article, should be able to attain peak operating temperature within 2 seconds, preferably in about 1 second. The size and power requirements of the heater having a multiple-layer ceramic substrate are dictated by the size of the smoking article, because the heater and its power source must fit within the smoking article.

A heater having a multiple-layer ceramic substrate may be fabricated in accordance with the principles of the present invention so that the substrate is substantially solid. However, it has been found that heaters that are constructed to include cavities or air gaps may be preferable. The references to an external geometry similar to that described with respect to FIG. 1 in the following discussion describing preferred internal geometries is purely illustrative, and it should be understood that any of the external configurations described with respect to FIGS. 1, 2*a* and 2*b*, 3, and 4*a* and 4*b*, among others, may be constructed to have a variety of internal geometries to meet the needs of a particular application.

Figure 5:
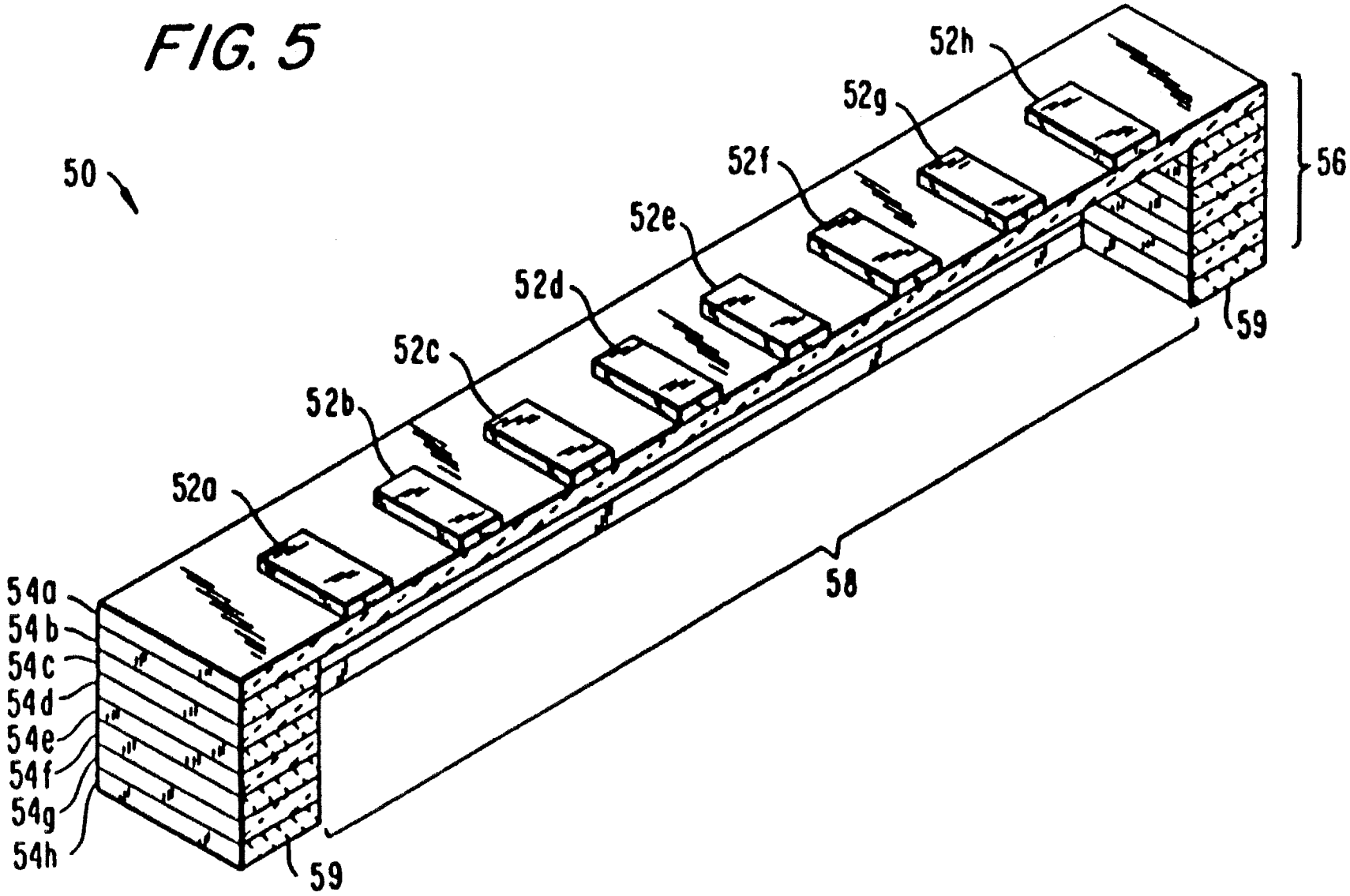
FIG. 5 is a cross-sectional perspective view of a heater having an exterior geometry as depicted in FIG. 1, and in which the interior comprises a single open cavity.

Referring now to FIG. 5, a heater having an external geometry described with respect to FIG. 1 is shown. Heater 50 includes substrate 56 constructed from a plurality of substrate layers 54*a*–54*h* which have been laminated using a process described in greater detail below. Upon surface substrate layer 54*a* are deposited a plurality of resistive heating elements 52*a*–52*h*.

Cavity 58 is provided within heater 50 to reduce the mass of substrate 56 under resistive heating elements 52*a*–52*h*, without sacrificing a substantial amount of mechanical strength. In this embodiment, the regions of substrate 56 in contact with resistive heating elements 52*a*–52*h* are at a minimum of thickness, thereby substantially reducing heat loss to substrate 56. Mechanical strength is provided by layered region 59, which extends around the border of heater 50.

Figure 6:
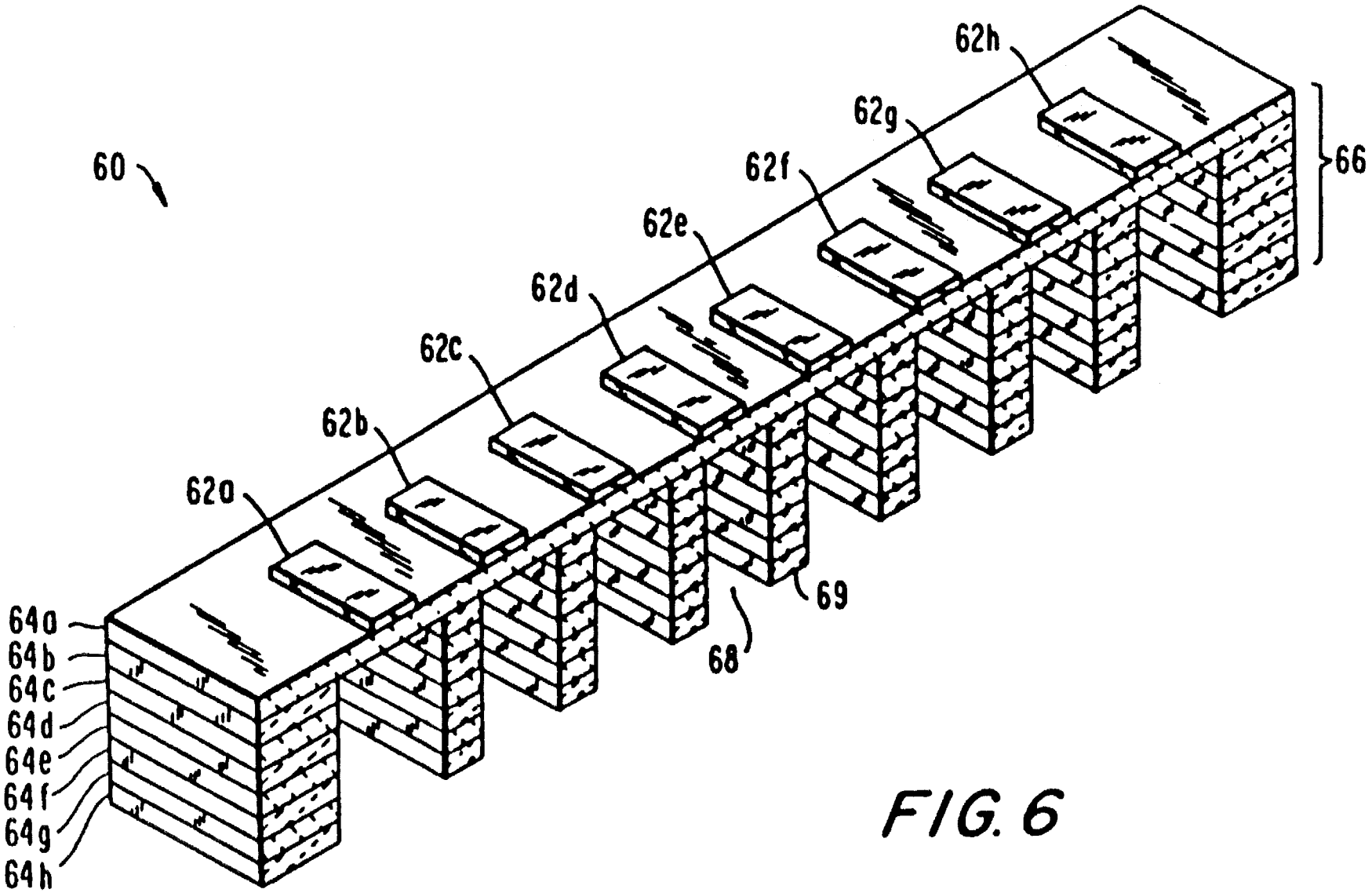
FIG. 6 is a cross-sectional perspective view of a heater having an exterior geometry as depicted in FIG. 1, and in which the interior comprises a plurality of open cavities.

Referring now to FIG. 6, an alternative embodiment of a heater having a multiple-layer ceramic substrate and a plurality of cavities is described. Similar to the heater described with respect to FIG. 1, heater 60 includes a substrate 66 constructed from a plurality of substrate layers 64*a*–64*h*. Upon surface substrate layer 64*a* are deposited resistive heating elements 62*a*–62*h*.

In this preferred embodiment, layered regions 69 are provided in substrate 66 between resistive heating elements 62*a*–62*h*. Additional layered regions 69 enhance mechanical strength, while maintaining the thickness of substrate 66 beneath resistive heating elements 62*a*–62*h* at a minimum. The number and location of cavities 68 (and layered regions 69) may vary, depending upon the number and size of the resistive heating elements, the size and geometry of the heater, as well as other factors relevant to a particular application.

Figure 7:
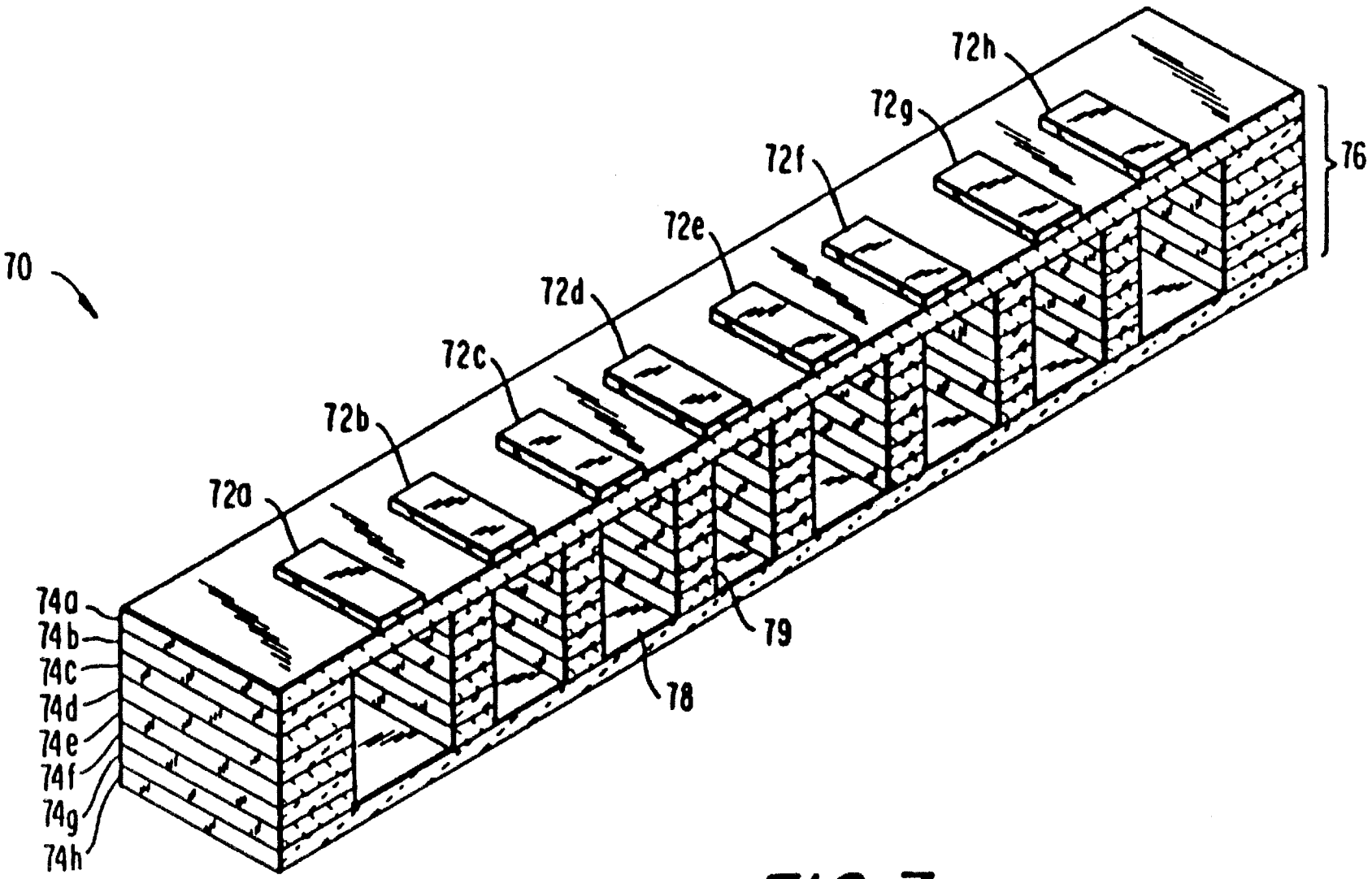
FIG. 7 is a cross-sectional perspective view of a heater having an exterior geometry as depicted in FIG. 1, and in which the interior comprises a plurality of enclosed cavities.

FIG. 7 depicts another illustrative embodiment of a heater having a multiple-layer ceramic substrate, in which completely enclosed cavities are provided. Heater 70 comprises substrate 76 constructed from substrate layers 74*a*–74*h*, and resistive heating elements 72*a*–72*h* deposited on substrate layer 74*a*.

In this embodiment, substrate layer 74*h* does not have regions removed, resulting in completely enclosed cavities 78 under resistive heating elements 72*a*–72*h*. Substrate layer 74*h*, having no regions removed, enhances the mechanical strength of heater 70, without adding thickness to the regions of substrate 76 beneath resistive heating elements 72*a*–72*h*. In a heater configuration in which resistive heating elements are deposited onto both surface substrate layers 74*a* and 74*h* of heater 70, enclosed cavities 78 may still be provided, by laminating to heater 70, surface substrate layer 74*h* having resistive heating elements deposited or adhered thereon.

Figure 8:
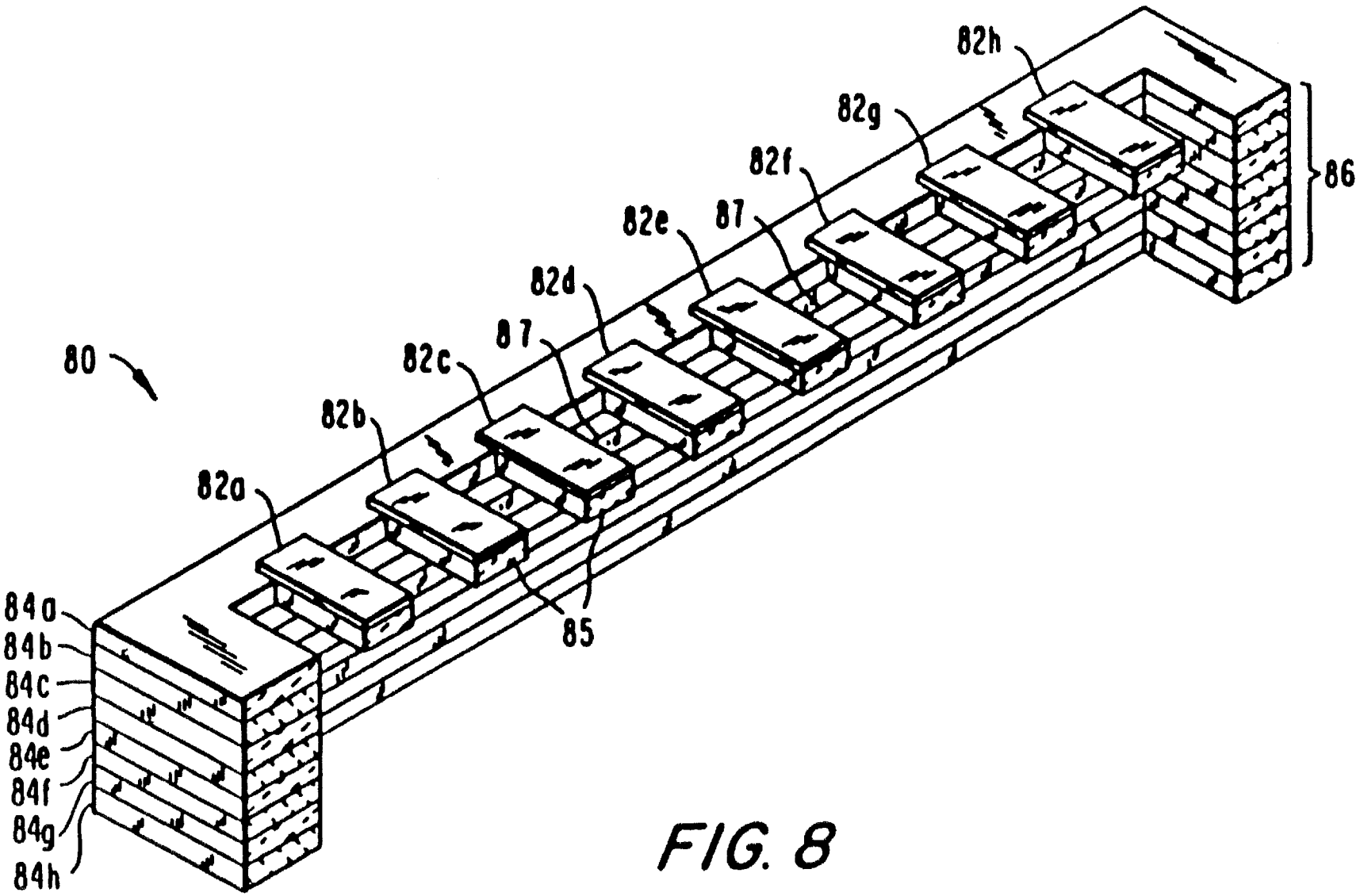
FIG. 8 is a cross-sectional perspective view of a fifth illustrative embodiment of a heater in accordance with the principles of the present invention, in which the resistive heating elements are separated by air gaps.

Referring now to FIG. 8, another illustrative embodiment of a heater having a multiple-layer ceramic substrate is described. Similar to the embodiments previously described, substrate 86 is constructed from substrate layers 84*a*–84*h*. However, in this preferred embodiment, resistive heating elements 82*a*–82*h* of heater 80 are deposited onto a plurality of ceramic bridges 87 formed in surface substrate layer 84*a*. Resistive heating elements 82*a*–82*h* are separated from each other by air gaps 87. Air gaps 87 serve to thermally isolate each resistive heating element, thereby substantially reducing heat loss to the surrounding substrate and to adjacent resistive heating elements.

The multiple-layer ceramic substrates used in the heaters of the present invention serve as a base members to support resistive heating elements deposited thereon. In addition, the individual substrate layers of the multiple-layer ceramic substrates may serve as media upon which electrically conductive traces are deposited (described in greater detail below). Therefore, the multiple-layer ceramic substrates should be mechanically strong, thermally stable and electrically insulating.

Ceramics are preferred over other substrate materials such as metals and polymers. Metallic substrates generally must be thermally insulated from the heating zones, because the high thermal conductivity of metals causes the substrate to absorb the heat generated by the resistive heating elements too quickly when the heater is energized. In addition, most metallic substrates also require electrical insulation because of their electrical conductivity. In contrast, most polymeric films are dielectrics requiring little electrical insulation; however, polymeric films require thermal insulation because they lack thermal stability above approximately 350° C.

Ceramics are particularly suitable for use as substrate material, because they provide strength as well as excellent thermal and electrical insulation for the resistive heating elements. Typical examples of suitable ceramic substrates may include alumina, zirconia (partially or fully stabilized either with yttria, calcia or magnesia), magnesia, yttria, cordierite, mullite, forsterite and steatite.

Ceramic substrates are available in the form of fired ceramic sheets and green tape. Although, as described below, green ceramic tape is preferred for fabricating multiple-layer ceramic substrates, fired ceramic sheets may also be used. Fired ceramic sheets comprising 96% alumina are available from Kyocera Corporation, located at 5–22 Kitainoue-Cho, Higashino, Yamashina-ku, Kyoto 67, Japan. Green ceramic tapes are available from E. I. du Pont de Nemours & Company, located in Wilmington, Del.

The thermal conductivity of the substrate should be tailored to match that of the resistive heating elements, to prevent the resistive heating elements from peeling away from the substrate during use, due to a mismatch in thermal expansion coefficients. Alumina is a preferred substrate material, because its thermal conductivity and strength can be controlled by varying the alumina loading in the green tape. Thermal conductivity of alumina in the temperature range of from 20° C. to 400° C. is shown below.

| | Conductivity (W/cm$^2$) | | | |
|---|---|---|---|---|
| Temperature, °C. | 99.9% | 96% | 90% | 85% |
| 20 | 0.39 | 0.24 | 0.16 | 0.14 |
| 100 | 0.28 | 0.19 | 0.13 | 0.12 |
| 400 | 0.13 | 0.10 | 0.08 | 0.06 |

The thermal stability of the substrate is a critical design consideration. The vapor pressure of the substrate material should be very low at temperatures up to about 900° C. Although the heaters of the present invention are designed to operate below 700° C. momentarily higher temperatures that may occur when the heaters are energized should not result in oxidation of the resistive heating elements (including oxidation due to dielectric breakdown). Oxidation which would increase the vapor pressure of the substrate can be expected from carbides and nitrides of titanium, molybdenum, silicon and possibly zirconium.

Green ceramic tapes that may be sintered at low temperatures are preferred for fabricating multiple-layer ceramic substrates, because low temperature sintering uses less energy and is less likely to degrade the heating zones. Acceptable tapes include specialty alumina tapes such as 851A2 tape manufactured by E. I. du Pont de Nemours & Company, located in Wilmington, Del. This borosilicate tape, which is cast on a mylar backing and requires a sintering temperature of about 850° C., contains between about 10% and about 30% alumina with the remaining portion comprising compounds of aluminum, boron, calcium, magnesium, potassium, sodium, silicon dioxide, and lead. In contrast, alumina tapes manufactured by Ceramtec Corporation, located in Salt Lake City, Utah, which have loadings at about 90% and about 96%, require sintering temperatures between about 1400° C. and about 1700° C. typically about 1550° C.

For a pure ceramic substrate material, sintering is generally carried out in an oxygen-rich environment. However, if resistive heating elements are printed on the green tape prior to sintering (as is the case in the preferred fabrication method, described in greater detail below), an atmosphere that is overly rich in oxygen could oxidize the elements excessively. Alumina, however, can be sintered in an oxygen-rich atmosphere or in a hydrogen atmosphere. For green tape, firing is preferably carried out in an atmosphere created by mixing air and nitrogen gas in a ratio of one part air for every two parts nitrogen gas. Some oxygen is required to ensure complete combustion of the carbonaceous compounds, although this is primarily of importance with respect to conductive pastes, since the incomplete burning of these compounds might result in excessive resistivity. Excessive oxidation during sintering may also cause the resistivity of the conductive paste to become too high.

Referring now to FIGS. 9*a*–9*c*, a method for fabricating a heater having a multiple-layer ceramic substrate in accordance with the principles of the present invention is described. To illustrate the preferred fabrication process, a heater having an external geometry as shown in FIG. 1 and an internal geometry as shown in FIG. 6 is described below. However, it should be understood that the principles of the present invention may be applied to fabricate heaters having multiple-layer ceramic substrates in a variety of configurations, depending on the requirements of a particular application.

Referring to FIG. 9*a*, heater 90 is shown in a cross-section taken near one of its longer edges, in order to expose the electrical connections to resistive heating elements 92*a*–92*h*. FIG. 9*b* depicts surface substrate layer 94*a* of substrate 96, and FIG. 9*c* is representative of any of substrate layers 94*b*–94*h*, as they may appear during the fabrication process.

In a preferred method for fabricating a heater having a multiple-layer ceramic substrate, a length of green ceramic tape is provided for each substrate layer. The length of green tape that is unrolled for processing one substrate layer should be at least as long as the length intended for the heater under construction. Preferably, green ceramic tape is provided in a substantially continuous manner, in order to facilitate high-speed fabrication of the substrate layers.

In each length of green ceramic tape that is provided, regions are removed, preferably by punching, to form via holes 100 and optionally, void regions 102. The locations selected for void regions 102 will depend upon the geometry chosen for the heater. For example, the layer shown in FIG. 9*b* is suitable for use as a surface substrate layer in any of the heaters depicted in FIGS. 5–7, because no void regions have been created. Heater 80 described with respect to FIG. 8 requires surface substrate layer 84*a* to incorporate void regions, in order to provide ceramic bridges 85 and air gaps 87. The substrate layer shown in FIG. 9*c* may be used as any of substrate layers 64*b*–64*h* in heater 60 described with respect to FIG. 6. A layer suitable for use as any of substrate layers 54*b*–54*h* in heater 50 described with respect to FIG. 5 would have a single void region surrounded by a border of green ceramic tape. Thus, some layers may comprise void regions, whereas other layers may be provided without void regions, and the size and number of void regions may vary depending upon the intended heater geometry.

In a preferred embodiment of the present invention, each layer of the multiple-layer ceramic heater comprises via holes 100. Via holes 100 are positioned in surface substrate layer 94*a* so that each of resistive heating elements 92*a*–92*h* will cover a pair of via holes 100 in surface substrate layer 94*a* when the resistive material is deposited in a subsequent manufacturing step. Via holes 100 in substrate layers 94*b*–94*h* are positioned so as to register with via holes 100 of surface substrate layer 94*a*. Thus, in each of substrate layers 94*a*–94*h*, sixteen via holes 100 are punched to allow for subsequent placement of eight resistive heating elements 92*a*–92*h* (although more or less via holes 100 could be punched, depending on the number of resistive heating elements used for a particular heater).

In the next step of the fabrication process, a conductive material is deposited into via holes 100. One skilled in the art will appreciate that the conductive material can be deposited into via holes 100 in several ways, including techniques such as sputtering, physical vapor deposition, chemical vapor deposition, thermal spraying and DC magnetron sputtering. However, most of these methods involve the use of fairly expensive equipment and require the processing steps to be performed in a vacuum.

A preferred technique for high-speed depositing of conductive material into via holes 100 is screen-printing. The screen-printing process involves forcing the conductive material in the form of a viscous thick-film paste through a stencil screen into via holes 100 on each substrate layer, in an amount sufficient to completely fill via holes 100. The stencil screen may be constructed from a stainless steel wire mesh or cloth, polyester or nylon filaments, or metalized polyester filaments. The mesh size may be tailored to the properties of the thick-film paste being used. A typical conductive thick-film paste comprises greater than 60% silver, between about 0.1% and about 1.0% platinum, and compounds of aluminum, boron, bismuth, calcium, magnesium, zinc, copper, sodium, silicon dioxide, lead, and ruthenium. Suitable conductive material may be obtained from E. I. du Pont de Nemours & Company, located in Wilmington, Del., and Electro-Scientific Industries, located in Mount Laurel, N.J.

The conductive thick-film paste is highly viscous, but its viscosity decreases sharply upon application of a shearing force, such as that applied to the paste when a rubber squeegee blade forces the paste through the stencil screen. Thus, upon application of the force, the paste rapidly flows through the screen and prints a pattern on the substrate. The viscosity of the conductive thick-film paste increases again when the force is withdrawn so that the paste retains its pattern after being printed into via holes 100.

The viscosity of the conductive thick-film paste may be adjusted by the addition of solvents or thinners such as pine oil, terpinol, butyl carbitol acetate or dibutylphthalate. Temporary binding materials such as polyvinyl acetate, ethyl cellulose or carboxymethylcellulose (CMC) may be used to increase the cohesion of the paste during screen printing and sintering. A permanent binder, such as glass, fuses the printed material to the substrate and remains after sintering.

After the conductive material has been printed into via holes 100, the conductive thick-film paste is permitted to settle for about 10 minutes, after which the organic solvents are removed by drying the substrate layers. Preferably, each layer is dried in air for between about 5 minutes and about 10 minutes, and further dried in an oven at between about 120° C. and about 150° C. for between about 10 minutes and about 15 minutes.

After the green ceramic tape has been dried, the tape may be cut from the roll, by a laser or other known means, to provide individual substrate layers. A second cutting step typically follows, in which each green ceramic type layer is trimmed so that heater 90 can fit within a smoking article. The trimming step may be accomplished by laser cutting or punching. Preferably, the substrate layers should be trimmed so that heater 90 is capable of fitting in a smoking article having a diameter of approximately 8 mm.

In the next step of the fabrication process, the green ceramic tape layers comprising conductor-filled via holes 100 and optionally, void regions 102, are laminated, preferably by using an isostatic press. If some of the green ceramic tape layers comprise void regions 102, the layers are stacked and aligned so that void regions 102 in each layer register with void regions 102 in the other layers, thereby forming cavities or air gaps in substrate 96. In addition, the individual layers are aligned so that conductor-filled via holes 100 in each layer register with conductor-filled via holes 100 in the other layers, thereby forming electrically conductive conduits 104*a*–104*h* from the exterior surface of surface substrate layer 94*a* to the exterior surface of surface substrate layer 94*h*. In addition, eight additional electrically conductive conduits (not shown) are formed through the opposite edge of substrate 96. Thus, surface substrate layer 94*h*, comprising a plurality of conductor-filled via holes 100 (one pair of via holes 100 for each of resistive heating elements 92*a*–92*h*), serves as a convenient electrical interface for independently connecting each of resistive heating elements 92*a*–92*h* to a power source within the smoking article.

After the green ceramic tape layers have been stacked, aligned and laminated, substrate 96 is subjected to a first firing process. In a first stage of the firing process, temporary organic binders are removed from substrate 96 by decomposition and air oxidation at temperatures in the range of from about 200° C. to about 500° C. In a second stage, which occurs at temperatures in the range of from about 500° C. to about 700° C., the permanent binder within the conductive thick-film paste, which is glass frit in a preferred embodiment, melts and wets the surfaces of substrate 96 and the conductive material. In a third stage, the temperature is raised to about 850° C. to sinter the particles of conductive material in the thick-film paste, causing them to become interlocked with the glass frit and substrate 96. In a final stage, substrate 96 is cooled from about 850° C. to about 50° C. The entire four-stage firing process can be completed in about 1 hour.

Upon completion of the first firing process, substrate 96 is in condition for the application of resistive heating elements 92*a*–92*h* onto surface substrate layer 94*a*. Preferably, heater 90 should operate with low voltage batteries and generate heat through resistive heating to a maximum temperature in the range of from about 400° C. to about 650° C. within 2 seconds, preferably in about 1 second. The power required for the heater to reach peak temperature should be in the range of from about 10 watts to about 20 watts. In a preferred smoking article embodiment, the batteries supply approximately 10 watts operating at 5 volts. Therefore, the desired resistance of a heater operating under the power constraint set by the batteries can be determined as follows:

$$R=E^2/P$$

Where

R=resistance (in ohms)

E=voltage (in volts)

P=power (in watts)

$$R=25/10=2.5\Omega$$

(where E=5 V and P=10 W)

From the above equations it can be seen that a 30% reduction in voltage reduces the power that a 2.5 Ω resistance draws by 50% to 5 W. For a resistance of 1.2 Ω, a voltage of 3.46 V will suffice to produce the desired power of 10 W. This example demonstrates that the electrical resistance of resistive heating elements 92*a*–92*h* must not change significantly during heating.

Conventional resistive heater materials such as graphite, nickel-chromium alloys, metallic strips, and lanthanum chromate are generally not suitable for use as resistive heating elements 92*a*–92*h*, because their low electrical resistivities may require excessive power to reach a temperature of between about 400° C. and about 650° C. Acceptable resistive materials include metallic or organometallic inks. A typical resistive ink comprises between about 10% and about 30% silver, between about 30% and about 60% palladium, and between about 10% and about 30% compounds of aluminum, boron, calcium, magnesium, zinc, barium, silicon dioxide, and titanium dioxide. Suitable resistive inks are available from E. I. du Pont de Nemours & Company, located in Wilmington, Del., and Electro-Scientific Industries, located in Mount Laurel, N.J.

Resistive heating elements 92*a*–92*h* generally have a thickness in the range of from about 0.6 mil (15 μm) to about 5.0 mils (125 μm), widths in the range of from about 1.0 mm to about 2.0 mm, and lengths in the range of from about 10 mm to about 16 mm; however, these dimensions may vary substantially depending upon the desired heater geometry. In a preferred embodiment, resistive heating elements 92*a*–92*h* are between about 1 mil (25 μm) and about 4 mils (25 μm) thick, about 1.3 mm wide, and about 13 mm long.

As discussed above with respect to the application of the conducive material into via holes 100, a variety of techniques may be employed to deposit the resistive material onto surface substrate layer 94*a* of substrate 96 to form resistive heating elements 92*a*–92*h*. Such methods include sputtering, physical vapor deposition, chemical vapor deposition, deposition of amorphous diamond film, and DC magnetron sputtering. Preferably, high speed application of resistive material to surface substrate layer 94*a* is accomplished by screen-printing, using the method described for depositing conductive material into via holes 100.

The screen pattern used to deposit the resistive material is designed so that each resistive heating element is deposited on a pair of electrically conductive conduits. One conduit of the pair independently connects the resistive heating element printed thereon to a power source, and the other conduit of the pair connects the resistive heating element to ground.

After the resistive material has been deposited onto surface substrate layer 94*a*, the resistive thick-film paste is permitted to settle for about 10 minutes, after which the organic solvents are removed by drying the heater assembly. Preferably, the assemblies are dried in air for between about 5 minutes and about 10 minutes, and further dried in an oven at between about 120° C. and about 150° C. for between about 10 minutes and about 15 minutes.

After the assemblies have been dried, a second firing step is performed, using the same four-stage process as described for the application of the conductive material into via holes 100 of substrate layers 94*a*–94*h*. The second firing process causes the resistive material to adhere to substrate 96, and results in good ohmic contacts between resistive heating elements 92*a*–92*h* and the electrically conductive conduits.

In an alternative method for fabricating a multiple-layer ceramic heater, and in particular, for fabricating heaters having internal resistive heating elements, resistive heating elements 92*a*–92*h* are deposited on surface substrate layer 94*a* before the lamination step. In the lamination step, surface substrate layer 94*a* may be stacked onto substrate layers 94*b*–94*h* such that resistive heating elements 92*a*–92*h* are internal to heater 90. An electrical contact is made between resistive heating elements 92*a*–92*h* and conductor-filled via holes 100 in substrate layer 94*b*. When this method is used, there is no need for second drying and firing steps. Furthermore, it is not necessary to punch via holes 100 in surface substrate layer 94*a*.

Referring now to FIGS. 10*a*–10*d*, another preferred embodiment of a heater having a multiple-layer ceramic substrate, and a method for fabricating the heater, are described. Heaters having external and internal geometries similar to those described with respect to FIGS. 1–8, among others, may be fabricated in accordance with this method. However, when this method is used, heaters may be fabricated to further include a terminal, in which the electrical connections to the resistive heating elements terminate in proximity to one another. A heater having a terminal in accordance with the principles of the present invention provides for convenient mechanical and electrical interfacing to a smoking article. For example, a smoking article can be designed to include a receptacle that allows the terminal of the heater to be easily and securely inserted into the smoking article.

Figure 10A:
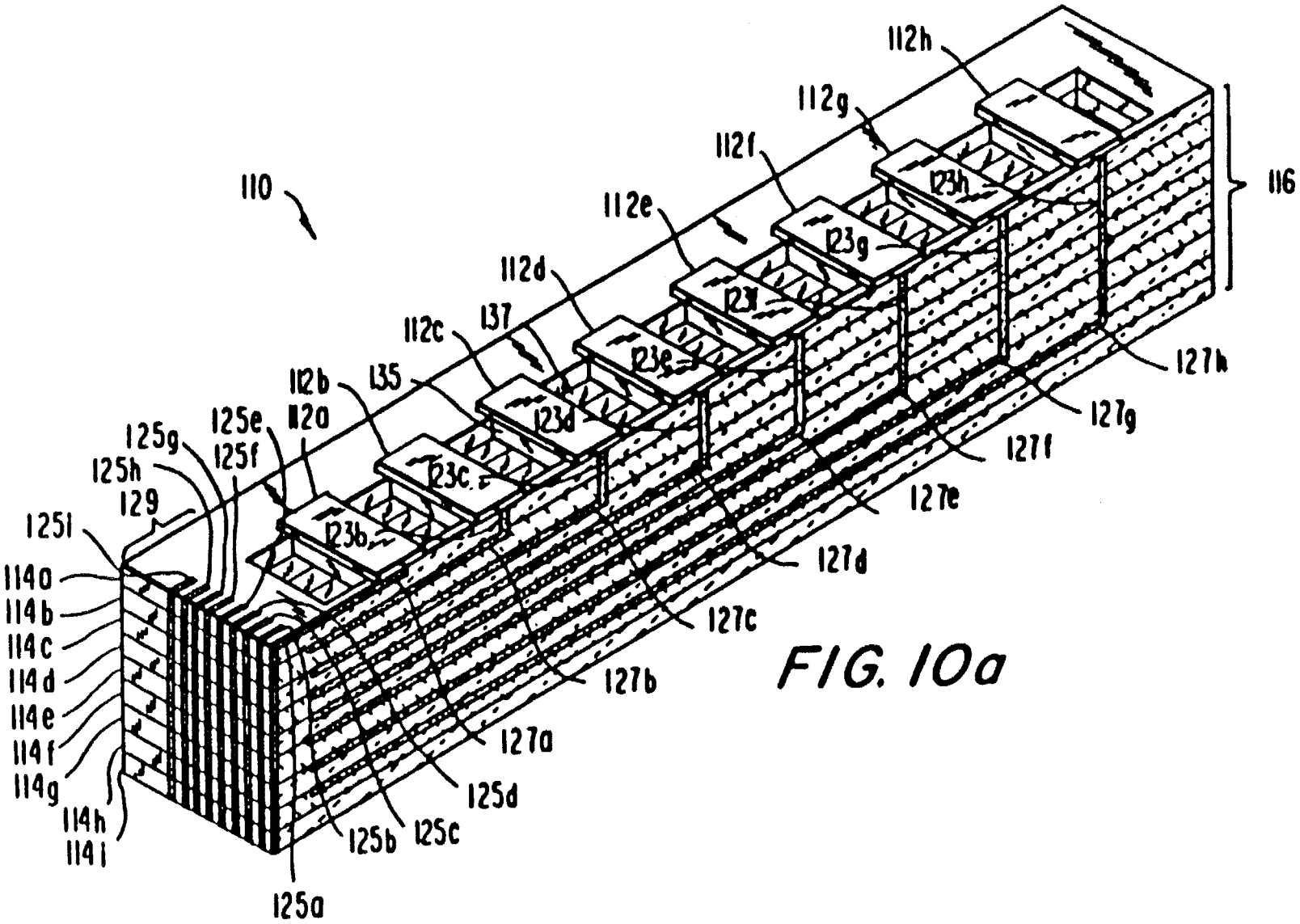
FIGS. 10*a*–10*d* illustrate a process by which a heater comprising electrically conductive conduits and conductive traces is fabricated in accordance with the principles of the present invention.
Figure 10D:
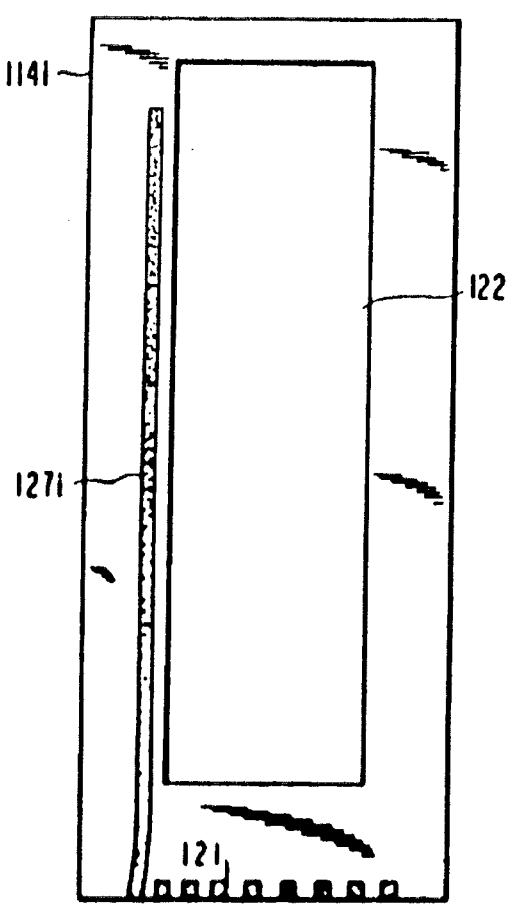
Figure 10C:
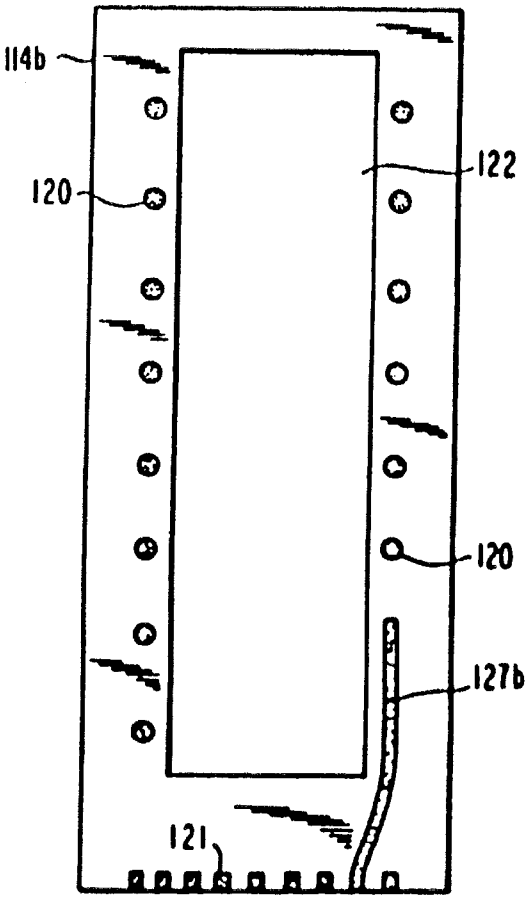
Figure 10B:
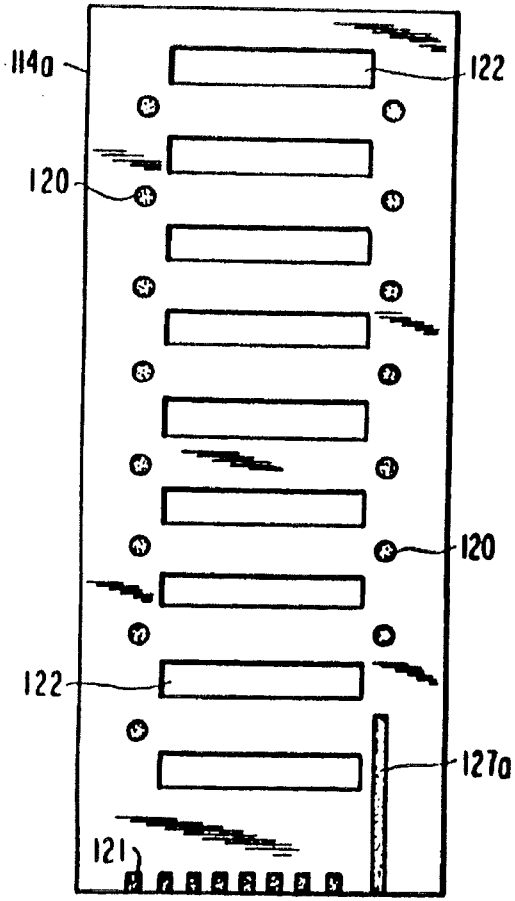

Referring to FIG. 10*a*, heater 110 is shown in a cross-section taken near one its longer edges, in order to expose the electrical connections to resistive heating elements 112*a*–112*h*. In this preferred embodiment, substrate 116 includes nine substrate layers 114*a*–114*i*. FIGS. 10*b*, 10*c*, and 10*d* depict, respectively, substrate layers 114*a*, 114*b*, and 114*i*, as they may appear during the fabrication process.

This method for fabricating a heater having a multiple-layer ceramic substrate is similar to the method described with respect to FIGS. 9*a*–9*c*; however it differs in two important respects. First, the step of punching via holes 120 and void regions 122 in substrate layers 114*a*–114*i* further includes punching additional via holes 121, which, when filled with a conductive material, form electrical contacts 125*a*–125*i* on heater 110 after substrate layers 114*a*–114*i* are laminated. Second, the step of depositing conductive material into via holes 120 and 121 further includes depositing additional conductive material to form electrically conductive traces 127*a*–127*i* on, respectively, substrate layers 114*a*–114*i*.

Preferably, in this embodiment, a heater comprising N resistive heating elements comprises at least N+1 substrate layers. Heater 110 described with respect to FIGS. 10*a*–10*d* comprises eight resistive heating elements 112*a*–112*h*, and nine substrate layers 114*a*–114*i*; however, variations in the number of resistive heating elements and substrate layers are possible.

Substrate layers 114*a*–114*i* each include nine conductor-filled via holes 121 near one of the narrow edges of heater 110. After substrate layers 114*a*–114*i* are laminated and fired, the aligned via holes 121 form electrical contacts 125*a*–125*i* in a region defining terminal 129. Electrical contacts 125*a*–125*h* provide independent electrical connections between resistive heating elements 112*a*–112*h* and a power source. Electrical contact 125*i* provides a common connection from all of resistive heating elements 112*a*–112*h* to ground.

As illustrated in FIGS. 10*b*–10*d*, in a preferred embodiment, each of substrate layers 114*a*–114*h* has via holes 120 and void regions 122 removed therefrom. Substrate layer 114*a* includes a plurality of void regions 122 interposed between regions of substrate layer 114*a* that will serve to support resistive heating elements 112*a*–112*h*. Substrate layers 114*b*–114*i* each have a single large void region 122. Thus, when the fabrication process is completed, heater 110 (as shown in FIG. 10*a*) has resistive heating elements 112*a*–112*h* deposited onto a plurality of ceramic bridges 135, which are separated from each other by air gaps 137. The interior of heater 110 consists of a single open cavity.

The number of via holes 120 along one edge of each layer (in this embodiment, the right edge) is successively reduced from seven in substrate layer 114*a* to zero in substrate layer 114*i*. Thus, when the layers are laminated (as shown in FIG. 10*a*), a plurality of electrically conductive conduits 123*b*–123*h* are formed, which penetrate into heater 110 to successively greater depths. There is no electrically conductive conduit in contact with the right edge of resistive heating element 112*a*, because, as will be shown below, it is not necessary.

Substrate layers 114*a*–114*h* also have, respectively, electrically conductive traces 127*a*–127*h* deposited thereon. Each electrically conductive trace starts at a location on the respective substrate layer that corresponds to the location on surface substrate layer 114*a* upon which the right edge of a resistive heating element will be deposited. For example, on surface substrate layer 114*a*, electrically conductive trace 127*a* starts at the location upon which the right edge of resistive heating element 112*a* will be deposited. For substrate layer 114*b*, electrically conductive trace 127*b* starts at the location on substrate layer 114*b* that is below the location on surface substrate layer 114*a* upon which the right edge of resistive heating element 114*b* will be deposited. The same principle is applied for each of substrate layers 114*c*–114*h*. In this manner, each of electrically conductive traces 127*b*–127*h* will contact a corresponding one of electrically conductive conduits 123*b*–123*h* when substrate layers 114*a*–114*i* are laminated. Electrically conductive trace 127*a* will make direct contact with resistive heating element 112*a*; therefore, no electrically conductive conduit is necessary for making an electrical connection with the right edge of resistive heating element 114*a*.

Electrically conductive traces 127*a*–127*h* are deposited along the right edge of substrate layers 114*a*–114*h*, respectively, and terminate at electrical contacts 125*a*–125*h*, respectively. The region of each substrate layer corresponding to the region defined as terminal 129 in heater 110 does not incorporate void regions, in order to allow electrically conductive traces 127*b*–127*h* to extend inward to connect with the corresponding electrical contacts 125*b*–125*h*.

FIG. 10*d* depicts substrate layer 114*i*, onto which electrically conductive trace 127*i* is deposited. Electrically conductive trace 127*i* commonly connects the electrically conductive conduits (not shown) extending from the left edges of resistive heating elements 112*a*–112*h* to electrical contact 125*i*. Electrical contact 125*i* thereby provides a connection to ground for all of resistive heating elements 112*a*–112*h*. In this preferred embodiment, substrate layer 114*i* does not provide an independent electrical connection between a power source and any of the resistive heating elements; however, in an alternative embodiment, substrate layer 114*i* may provide the ground connection as well as an independent electrical connection to resistive heating element 112*h*. Using this method, only N substrate layers would be required for N resistive heating elements.

After the conductive material has been deposited to form conductor-filled via holes 120 and 121, and electrically conductive traces 127*a*–127*i*, substrate layers 114*a*–114*i* are laminated and fired, as described with respect to FIGS. 9*a*–9*c*. Then, resistive heating elements 112*a*–112*h* may be applied, after which, heater 110 may be post-fired.

FIG. 10*a* depicts heater 110 (in cross-section) after substrate layers 114*a*–114*i* have been laminated and resistive heating elements 112*a*–112*h* have been printed. Electrically conductive conduits 123*b*–123*h* are formed by the alignment of via holes 120 along the right edge of substrate layers 114*b*–114*h*. Additional electrically conductive conduits are formed (not shown), extending from the left edges of resistive heating elements 112*a*–112*h* to substrate layer 114*i*, to connect resistive heating elements 112*a*–112*h* to electrically conductive trace 127*i*. As is shown in FIG. 10*a*, electrically conductive conduits 123*b*–123*h* extend from resistive heating elements 112*b*–112*h*, respectively, to substrate layers 114*b*–114*h*, respectively. There is no electrically conductive conduit connecting resistive heating element 112*a* to electrically conductive trace 127*a*, because one end of electrically conductive trace 127*a* is in direct contact with resistive heating element 112*a*. By appropriately selecting the depths of electrically conductive conduits 123*b*–123*h*, the electrical connection for each resistive heating element is electrically insulated from the other electrical connections by the interposed substrate layers. Thus, each resistive heating element has a separate connection to a power source, and each resistive heating element may be independently actuated by control means within the smoking article.

The method as described with respect to FIGS. 10*a*–10*d* is particularly useful for fabricating heaters having an external geometry in which resistive heating elements are disposed on both surface substrate layers of the heater, as shown, for example, in FIGS. 2*a* and 2*b*, and 4*a* and 4*b*. Without electrical terminal 129, the resistive heating elements on one side of the heater would obstruct access to the electrically conductive conduits corresponding to the resistive heating elements on the opposite side of the heater, thereby making an electrical connection difficult.

Several other alternative configurations are possible using the method as described with respect to FIGS. 10*a*–10*d*. For example, the substrate layer selected to provide the ground connection may be modified to be, for example, any of substrate layers 114*a*–114*h*. If a heater geometry similar to the one described with respect to FIG. 3 is desired, electrically conductive trace 127*i* may extend along surface substrate layer 114*a* from a region of conductive material deposited between the two banks of resistive heating elements to electrical contact 125*i*.

Other modifications may include interleaving additional substrate layers between the layers comprising electrically conductive traces 127*a*–127*i*, so as to provide additional electrical and thermal insulation, as well as enhanced mechanical stability. Also, when additional substrate layers are interleaved, electrically conductive traces 127*a*–127*i* may be printed as deep-well electrically conductive traces that offer less resistance to current flow. Such deep-well electrically conductive traces may be provided by removing regions that define the electrically conductive traces on alternate substrate layers prior to depositing the conductive material. Another possible modification would be to deposit a plurality of conducting traces on a single substrate layer, to reduce the thickness of the heater. This technique would be limited by the existence of cavities or air gaps in the substrate layers.

One skilled in the art will appreciate that the present invention can be practiced by other than the described embodiments, which are presented for purposes of illustration and not of limitation, and the present invention is limited only by the claims which follow.

What is claimed is:

1. An electrically powered heater comprising:

a plurality of adhered ceramic layers forming a multiple-layer ceramic substrate, said multiple-layer substrate having a first surface substrate layer and a second surface substrate layer, said second surface substrate layer comprising border portions adhered to an inner side of said first surface substrate layer along an outer border of said first surface substrate layer; and a resistive heating element disposed on an outer side of said first surface substrate layer, wherein an internal cavity is defined by the inner side of said first surface substrate layer and inner sides of the border portions of second surface substrate layer.

2. The heater of claim 1, wherein said resistive heating element is formed from a resistive ink comprising between about 10% and about 30% silver and between about 30% and about 60% palladium.

3. The heater of claim 1, wherein said resistive heating element has a thickness of between about 15 μm and about 125 μm.

4. The heater of claim 1, wherein said multiple-layer ceramic substrate comprises material selected from the group consisting of alumina, zirconia, magnesia, yttria, cordierite, mullite, forsterite and steatite.

5. The heater of claim 1, wherein:

said heater is shaped and dimensioned for incorporation into a smoking article; and said resistive heating element has an electrical resistance which causes said resistive heating element to attain a temperature sufficient to cause a tobacco flavor medium applied to said resistive heating element to generate an inhalable aerosol when electrical energy is supplied to said resistive heating element.

6. The heater of claim 5, wherein said resistive heating element has an electrical resistance of between about 0.2 Ω and about 2.0 Ω.

7. The heater of claim 1, wherein said multiple-layer ceramic substrate further comprises a third substrate layer adhered to said second surface substrate layer, said third substrate layer enclosing the internal cavity.

8. The heater of claim 1, wherein said heater comprises a plurality of resistive heating elements disposed on the outer side of said first surface substrate layer and a plurality of resistive heating elements disposed on an outer side of said second surface substrate layer.

9. The heater of claim 1, wherein said heater comprises a plurality of resistive heating elements disposed on said first surface substrate layer.

10. The heater of claim 9, wherein said plurality of resistive heating elements are disposed on said first surface substrate layer and are electrically insulated from one another.

11. The heater of claim 9, wherein said second surface substrate layer comprises a plurality of regions between the border portions defining open cavities within the internal cavity, each open cavity respectively underneath each of the plurality of resistance heating elements.

12. The heater of claim 11, wherein said multiple-layer ceramic substrate comprises a bottom substrate layer adhered to said second surface substrate layer, said bottom substrate layer enclosing the defined cavities.

13. The heater of claims 9, wherein:

said first surface substrate layer comprises a plurality of ceramic bridges extending between the outer border of said first surface substrate layer and upon which said plurality of resistive heating elements are disposed, said plurality of ceramic bridges being separated from each other by a plurality of regions defining air gaps in said first surface substrate layer.

14. The heater of claim 9, wherein another plurality of resistive heating elements are disposed in an outer side of said second surface substrate layer.

15. The heater of claim 9, wherein said plurality of resistive heating elements are independently connectable to a power source.

16. The heater of claim 9, wherein said multiple-layer ceramic substrate comprises at least one interior substrate layer, said at least one interior substrate layer comprising border portions corresponding and adhering to the border portions of said second surface substrate layer, the border portions of said at least one interior substrate layer adhered alone the outer border of the inner side of the first substrate layer, the internal cavity further defined by inner sides of the border portions of said at least one interior substrate layer,

17. The heater of claim 9, wherein said multiple-layer ceramic substrate comprises a plurality of interior substrate layers having respective border portions, inner sides of the border portions of said plurality of interior substrate layers further defining the internal cavity.

18. The heater of claim 17, further comprising means for receiving electrical energy and delivering said electrical energy to said plurality of resistive heating elements.

19. The heater of claim 18, wherein said means for receiving and delivering electrical energy comprises a plurality of electrically conductive conduits.

20. The heater of claim 19, wherein:

each of said plurality of resistive heating elements has a first end and a second end;

said plurality of electrically conductive conduits are organized in pairs, wherein a first conduit in each of said pairs is in electrical contact with said first end of one of said resistive heating elements, and a second conduit of each of said pairs is in electrical contact with said second end of said one of said resistive heating elements; and said plurality of electrically conductive conduits extend from said plurality of resistive heating elements through said multiple-layer ceramic substrate and terminate at an exterior surface of said second surface substrate layer to provide independent electrical connections to a power source for each of said plurality of resistive heating elements.

21. The heater of claim 20, wherein said first electrically conductive conduit in each of said pairs connects one of said plurality of resistive heating elements to said power source and said second electrically conductive conduit in each of said pairs connects said one of said plurality of resistive heating elements to ground.

22. The heater of claim 18 further comprising a terminal for providing a mechanical and electrical interface to a receptacle for receiving said heater.

23. The heater of claim 22, wherein said terminal comprises a plurality of electrical contacts for providing independent electrical connections to said plurality of resistive heating elements.

24. The heater of claim 23, wherein said means for receiving and delivering electrical energy comprises:

a plurality of electrically conductive conduits disposed within said multiple-layer ceramic substrate; and a plurality of electrically conductive traces, each trace disposed respectively on one of a plurality of said ceramic layers of said multiple-layer ceramic substrate and extending from said plurality of electrically conductive conduits to a plurality of said electrical contacts in said terminal.

25. The heater of claim 24, wherein each of said plurality of resistive heating elements has a first end and a second end;

a plurality of said electrically conductive conduits are organized in pairs, each of said pairs comprising a first conduit and a second conduit;

said first conduit of each of said pairs contacts said first end of one of said plurality of resistive heating elements and extends through said multiple-layer ceramic substrate to contact one of said plurality of electrically conductive traces, which provides a ground connection for said plurality of resistive heating elements; and said second conduit of each of said pairs contacts said second end of one of said plurality of resistive heating elements and extends through said multiple-layer ceramic substrate to independently contact one of said plurality of electrically conductive traces.

26. The heater of claim 25, wherein at least one of said plurality of electrically conductive traces directly connects said second end of at least one of said plurality of resistive heating elements to one of said plurality of electrical contacts in said terminal.

27. The heater of claim 25, wherein there is one more total number of layers of said multiple-layer ceramic substrate than a total number of said plurality of resistive heating elements.

* * * * *